US007708278B2

(12) United States Patent
Norbits

(10) Patent No.: US 7,708,278 B2
(45) Date of Patent: May 4, 2010

(54) FISHING GAME

(76) Inventor: G. Theodore Norbits, 214 Harbor Pointe Dr., East Peoria, IL (US) 61611

( * ) Notice: Subject to any disclaimer, the term of this patent is extended or adjusted under 35 U.S.C. 154(b) by 0 days.

(21) Appl. No.: 12/284,249

(22) Filed: Sep. 19, 2008

(65) Prior Publication Data

US 2009/0079135 A1 Mar. 26, 2009

Related U.S. Application Data

(60) Provisional application No. 60/994,565, filed on Sep. 20, 2007.

(51) Int. Cl.
*A63F 1/00* (2006.01)

(52) U.S. Cl. ..... 273/140

(58) Field of Classification Search ..... None
See application file for complete search history.

(56) References Cited

U.S. PATENT DOCUMENTS 2,230,814 A * 2/1941 Roth ..... 273/379
2,392,147 A * 1/1946 Hickson ..... 43/42.74
2,598,487 A * 5/1952 Anechiarico ..... 446/132
3,463,494 A * 8/1969 Stroh ..... 273/348.3
3,659,372 A * 5/1972 Cullen ..... 43/44.88
4,229,003 A * 10/1980 Shimizu ..... 273/448
4,272,075 A * 6/1981 Rogers, Jr. ..... 273/448
4,744,565 A * 5/1988 Newberger ..... 273/342
4,871,200 A * 10/1989 Ryder et al. ..... 289/17
4,976,439 A * 12/1990 Kraemer ..... 273/350
5,094,461 A * 3/1992 Lowrance ..... 273/343
5,110,136 A * 5/1992 Land ..... 273/348.4
5,141,465 A * 8/1992 Stellman ..... 273/447
5,267,409 A * 12/1993 Voss ..... 43/42.74
5,297,355 A * 3/1994 O'Brien ..... 43/4
5,397,131 A * 3/1995 Kraemer ..... 273/350
5,452,902 A * 9/1995 Foster et al. ..... 273/348.4
5,566,949 A * 10/1996 Gorden ..... 273/348.3
5,609,341 A * 3/1997 Chuang ..... 273/448
5,639,093 A * 6/1997 Law et al. ..... 273/371
5,722,663 A * 3/1998 Avigal et al. ..... 273/448
5,896,693 A * 4/1999 Ray ..... 43/4
6,402,617 B2 * 6/2002 Gouji et al. ..... 463/37
6,412,211 B1 * 7/2002 Smith ..... 43/4
6,550,774 B1 * 4/2003 Stroll et al. ..... 273/447
6,786,486 B1 * 9/2004 Otremba ..... 273/282.1
6,862,838 B1 * 3/2005 Gibbs ..... 43/44.98
7,383,658 B1 * 6/2008 Reichert et al. ..... 43/26

* cited by examiner

*Primary Examiner*—Gene Kim
*Assistant Examiner*—Dolores Collins
(74) *Attorney, Agent, or Firm*—Philip L. Bateman

(57) ABSTRACT

A fishing game is played with a rod, a reel, and line. A holder is connected to the end of the line and an engaging fabric marker is removably attached to the holder. The holder and marker are cast at a target having an engaging fabric surface. If the marker lands on the target, it remains engaged to the target and separates from the holder when the line is retrieved.

1 Claim, 2 Drawing Sheets

FISHING GAME

CROSS-REFERENCE TO RELATED APPLICATION

This application claims the benefit of U.S. Provisional Application Ser. No. 60/994,565, Sep. 20, 2007.

FIELD OF THE INVENTION

This invention relates to fishing and amusement devices. More particularly, this invention relates to fishing games.

BACKGROUND OF THE INVENTION

Fishing is a popular recreational activity. Most recreational fishing is done with a rod, a reel to hold a line, and a hook on the end of the line. Combined with the hook is a bait (food such as worms, small fish, cheese, bread, etc.) or a lure (an artificial fish or insect) to attract the fish to bite. In one method of fishing known as casting, the fisherman flips the rod to cast the lure at a desired spot on the water. The fisherman then slowly retrieves the line. The movement of the lure on or through the water increases the likelihood of a bite. Precision casting is a skill that can be improved with practice.

A variety of fishing games have been disclosed for the dual purposes of fun and improving a fisherman's skill at casting. The games use a standard rod, reel, and line, but substitute a game piece for the lure. One such fishing game is disclosed in Land, U.S. Pat. No. 5,110,136, May 5, 1992. In the Land game, the lure is replaced with a cylinder covered with a hook engaging material such as VELCRO hook-and-loop fabric. The cylinder is cast at fish-shaped targets spread out on the ground or water. The targets are covered with a contact engaging material. When the cylinder lands on one of the targets, an engagement (i.e., a temporary attachment) is made. The target is then retrieved using the reel. When the Land fishing game is played, a cast results in either a hit or a miss. There is no means for rewarding a near hit.

A second fishing game is disclosed in Howard, U.S. Pat. No. 5,657,995, Aug. 19, 1997. In the Howard game, the lure is replaced by a ball. The ball is cast at a game board containing multiple hinged doors. If the ball lands directly on a door, an artificial fish with a suction cup nose springs up through the door and attaches itself to the ball. As with the Land game, the Howard game has no means for rewarding a near hit.

A third fishing game is disclosed in Smith, U.S. Pat. No. 6,412,211, Jul. 2, 2002. In the Smith game, the lure is replaced with a fly that is covered with a hook-and-loop fabric. The fly is cast at mats covered with mating hook-and-loop-fabric that are spread out on the ground. A fish replica is mounted near the mat to provide visual appeal. If the fly lands on the mat, it engages. Winding the reel causes the fly to disengage from the mat and enables it to be retrieved for another cast. As with the Land and the Howard games, the Smith game has no means for rewarding a near hit.

Accordingly, a demand exists for a fishing game with a graduated scoring system that provides rewards as casts get closer to a designated spot on the target. A demand also exists for a fishing game in which each cast leaves a visual indication of its location on the target.

SUMMARY OF THE INVENTION

The general object of this invention is to provide an improved fishing game.

I have invented a fishing game for use with a rod, a reel attached to the rod, and a line retrievable by the reel. The game comprises: (a) a target having a surface comprising an engaging fabric; (b) a holder connected to the line; and (c) a marker removably attached to the holder, the marker having a surface comprising a fabric that engages the fabric of the target when brought into contact, the engagement to the target fabric being stronger than the attachment to the holder so that the marker separates from the holder and stays on the target when the line is retrieved.

The fishing game of this invention is fun to play and improves the player's skill at casting. The game contains a graduated scoring system that provides rewards as casts get closer to a designated spot on the target. The game also leaves a visual indication of the location of each cast on the target.

DETAILED DESCRIPTION OF THE INVENTION

Figure 1:
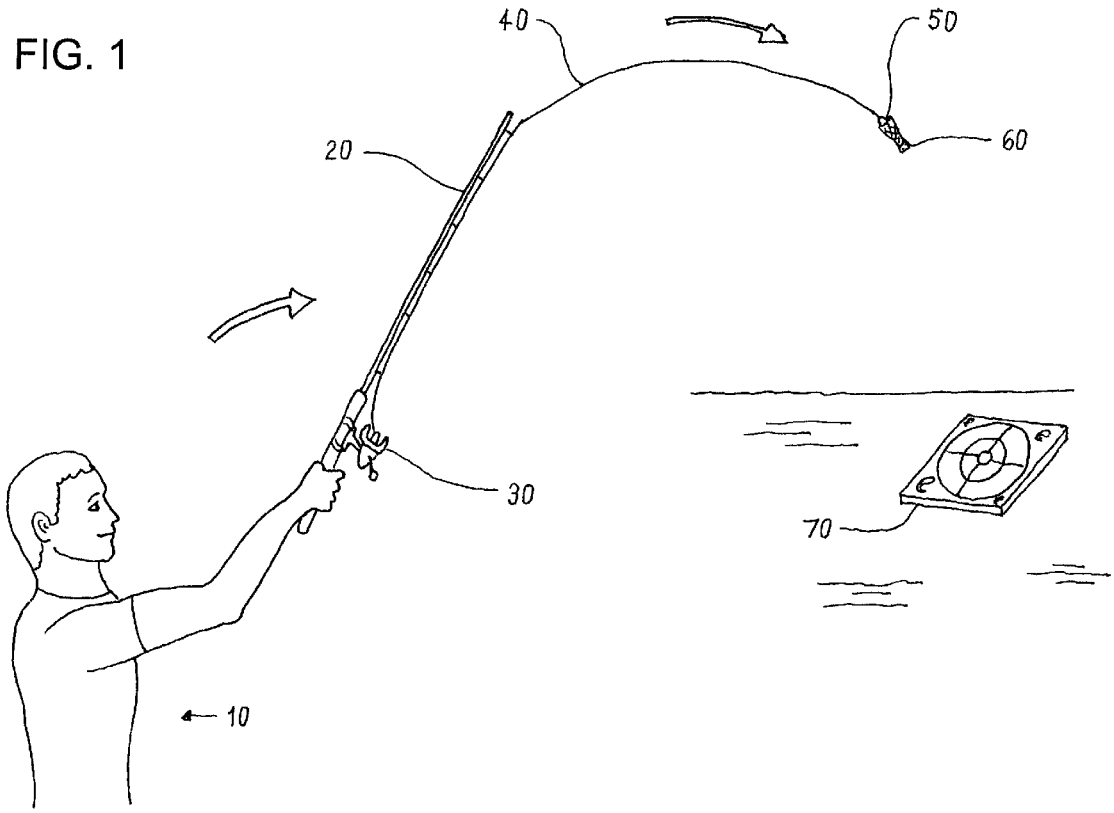
FIG. 1 is a perspective view of a preferred embodiment of the fishing game of this invention.

This invention is best understood by reference to the drawings. Referring to FIG. 1, the fishing game of this invention is played by a person 10 using a conventional rod 20, reel 30, and line 40. The type of rod, reel, and line is a matter of choice. In most cases, the person uses the same equipment used when fishing. However, equipment dedicated for use with the game is also suitable. In place of a lure, a holder 50 is connected at the distal end of the line. One of a plurality of markers 60 is attached to the holder. A target 70 is placed on the ground or other surface. The holder, marker, and target are discussed in more detail below. The game is played by the person moving the rod to cast the holder and marker toward the target, as indicated by the two arrows.

Figure 2:
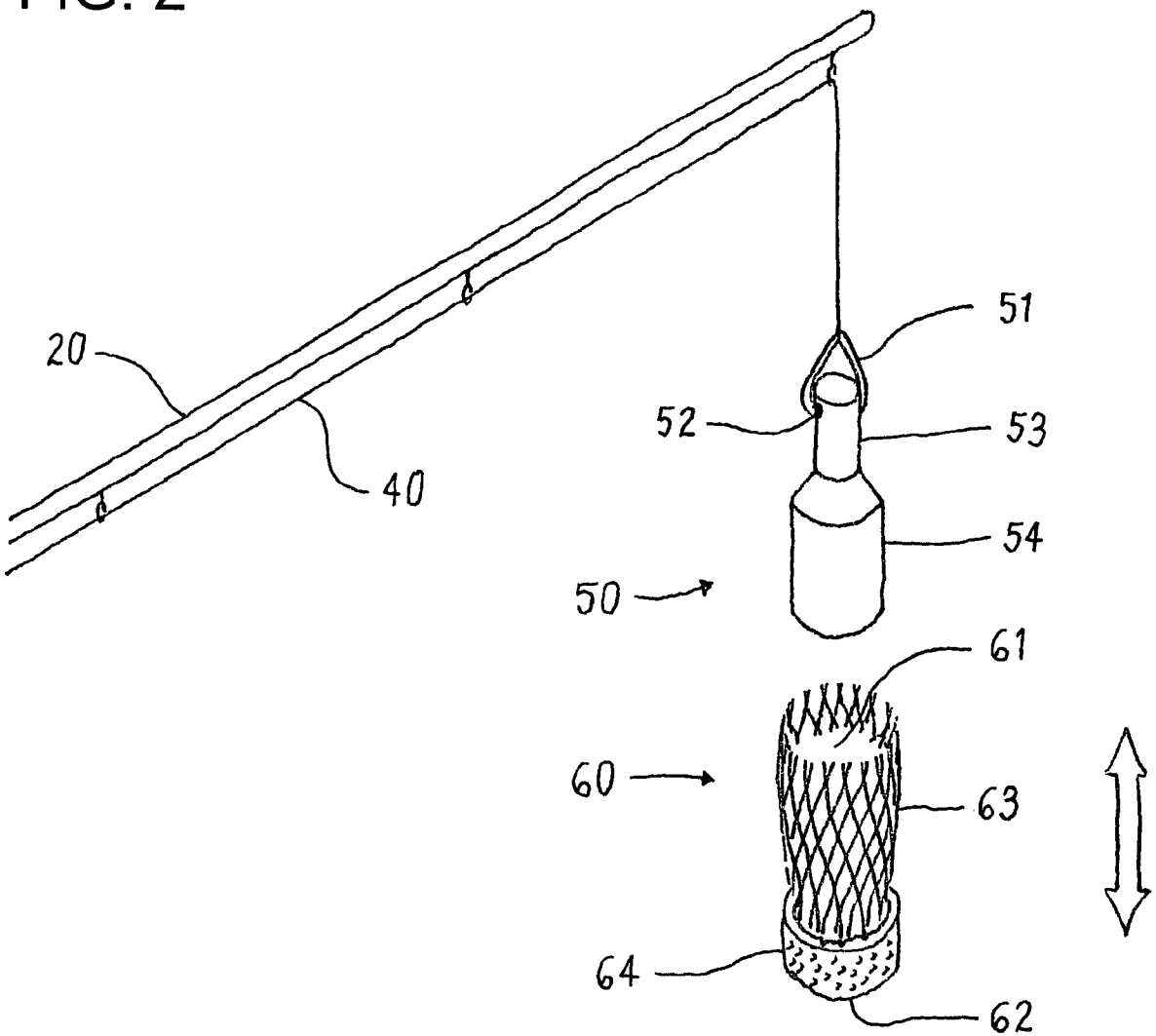
FIG. 2 is a detailed perspective view of the holder and marker thereof.

Referring now to FIG. 2, the holder 50 has two primary purposes. The first purpose is to provide a means for removably attaching a marker. The second purpose is to provide a mass (weight) that simulates the mass of a lure. The holder contains an opening, a hook, a connector, or other means for connection to the distal end of the fishing line. A preferred connection means is a metal ring 51 secured into an opening 52 that runs transversely through the proximate end of the holder.

The holder is preferably made of a resilient material. Rubber is the preferred resilient material for the holder because it has a high coefficient of friction, i.e., it has a tacky surface, that enables it to effectively hold the marker. The holder is preferably cylindrical in shape to maximize the surface area of contact with the marker.

For simulating casting with bass lures, the holder is preferably a resilient cylinder having a length of about one to three inches, a diameter of about one-fourth to three-fourths inches, and a mass of about one-eighth to one-half ounce. The holder shown in FIG. 2 is especially preferred for simulating casting with bass lures. It is a rubber plug that has one portion 53 having a diameter of about three-eighths inches and a second portion 54 having a diameter of about five-eighths inches. It has a length of about two inches and a mass of about one-fourth ounce. Fly fishing casting uses smaller and lighter weight lures than bass fishing. Accordingly, the preferred holder for simulating fly fishing casting is smaller and lighter in weight than the one illustrated. If desired, streamers or the like are added to the holder for increased visual appeal. For example, a plurality of flexible lines are easily secured to the holder by an elastic band around the proximate end of the holder.

The marker 60 of the preferred embodiment has a shape and a size that enables it to fit onto the holder. When the holder is cylindrical in shape, the marker is generally cylindrical in shape as well. The marker shown in FIG. 2 has an open, expanding end 61 that is placed on the holder first. The opposite end 62 of the marker is preferably fixed in size with an end disk to snugly engage the holder. As previously discussed, the marker must fit securely enough on the holder to stay on the holder during casting. The wall of the marker is preferably made of a lightweight expandable plastic mesh 63, similar in construction to the skirt of a recreational badminton shuttlecock.

The marker's outer wall surface at the fixed end is covered with a strip of material 64 that engages the target when they are brought into contact as the game is played. The material is preferably a hook-and-loop fabric such as VELCRO fabric. As is well known in the art, VELCRO fabric contains two mating materials, one of which comprises small hooks and one of which comprises small loops. The hooked material is most preferably used on the markers. The light weight and flexibility of the marker enables it to remain frictionally attached to the holder until intentionally removed, as described in detail below.

Referring back to FIG. 1, the target 70 has a surface comprising a fabric for engagement of the marker when they are brought into contact. Thus, when the marker material is a hooked material, the target surface is a material that engages the hooked material, such as felt or the looped portion of hook-and-loop fabric. The size, shape, and positioning of the target are matters of choice. As an example, the target shown in FIG. 1 is flat, square in shape with each side having a length of about two feet, and covered with a felt fabric. A pattern of concentric circles with an inner "bull's eye" is painted or otherwise affixed to the target. Four representations of fish are similarly placed in the corners. The target is positioned in any way desired. For example, it is laid flat on the ground, hung on a vertical surface, or placed at an angle by either leaning it against a prop or by including an angled support as part of the target.

The use of the game components to play the game can now be considered. The first step is to place the target at a desired location. The next step is to connect the holder to the distal end of the fishing line, if it is not already connected. The next step is to place the marker onto the holder. The player then casts the holder and marker toward the target using the same technique as used when casting a lure.

If the holder and marker land on the target, an engagement is made between the fabric on the marker and the fabric on the target. This engagement is stronger than the frictional attachment of the marker to the holder. As a result, when the line is retrieved, the marker stays on the target and separates from the holder. The holder is then fully retrieved and another marker can be placed onto it.

One popular method of playing the game is to follow rules similar to the game of darts. More particularly, one or more rounds are played in which two or more players take turns casting a small number of markers at the target. Each player's markers are preferably distinct in color so they can be distinguished. The location at which a marker lands on the target determines the points awarded, with the points increasing as the bull's eye is more closely approached. The previously-cast markers remain on the target as succeeding markers are cast. This enables the players to easily keep track of their scores as the round is played. The player with the most points wins the round. The markers are then picked up and another round can be played until the desired winning score is achieved.

Another method of playing the game is for a single player to practice his casting technique by casting the holder and marker toward the target. As previously discussed, playing the game is fun and improves a player's skill at casting. The game provides increasing rewards as casts get closer to a designated target. The game also leaves markers on the target so that players can keep track of their scores as subsequent casts are made.

I claim:

1. A fishing game for use with a rod, a reel attached to the rod, and a line retrievable by the reel, the game comprising:

(a) a target having a surface comprising an engaging fabric;

(b) a holder connected to the line, the holder comprising a resilient cylinder; and (c) a marker frictionally and removably attached to the holder, the marker comprising an expandable mesh cylinder having an open top and having an outer wall surface comprising a strip of hook and loop fabric that engages the fabric of the target when brought into contact, the engagement to the target fabric being stronger than the attachment to the holder so that the marker separates from the holder and stays on the target when the line is retrieved.

* * * * *